US006495786B1

(12) United States Patent
Tsuji et al.

(10) Patent No.: US 6,495,786 B1
(45) Date of Patent: Dec. 17, 2002

(54) VACUUM EXHAUST ELEMENT OF VACUUM SWITCH

(75) Inventors: Masashige Tsuji, Narashino (JP); Ayumu Morita, Hitachi (JP); Toru Tanimizu, Hitachi (JP); Katsunori Kojima, Hitachi (JP); Yuichi Ishikawa, Mito (JP); Yoshiharu Yotsumoto, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/677,602

(22) Filed: Oct. 3, 2000

(30) Foreign Application Priority Data

Oct. 7, 1999 (JP) ..... 11-286570

(51) Int. Cl.[7] ..... H01H 33/66
(52) U.S. Cl. ..... 218/118; 218/131; 218/120
(58) Field of Search ..... 218/43, 118, 120, 218/121, 122, 123, 130, 131, 134, 139, 140, 141, 142, 154

(56) References Cited

U.S. PATENT DOCUMENTS 4,163,130 A * 7/1979 Kubota et al. ..... 218/118
4,331,850 A * 5/1982 Lipperts ..... 218/118

FOREIGN PATENT DOCUMENTS

DE 3910010 A1 * 3/1989
JP 51-130873 11/1976

* cited by examiner

*Primary Examiner*—Lincoln Donovan
*Assistant Examiner*—Tuyen Nguyen
(74) *Attorney, Agent, or Firm*—Mattingly, Stanger & Malur, P.C.

(57) ABSTRACT

A vacuum exhaust element of a vacuum switch has an ordinary withstand voltage because the vacuum vessel and power source element are grounded, therefore not requiring the high voltage to be taken into consideration. This way, the vacuum exhaust element is miniaturized and it is safe for a worker to touch the vacuum vessel and the vacuum exhaust element when performing maintenance and/or inspection.

21 Claims, 7 Drawing Sheets

VACUUM EXHAUST ELEMENT OF VACUUM SWITCH

BACKGROUND OF THE INVENTION

The present invention relates to a vacuum switch with a vacuum exhaust element.

The interruption performance of a vacuum valve drops down suddenly at $10^{-4}$ Torr or below. A change in vacuum pressure is caused not only by the leakage of vacuum due to generation of cracking but also by the release of gas molecules adsorbed in metal or insulating material, further by the transmission of atmospheric gas, and so on. When a vacuum vessel becomes larger in size as a higher rated voltage is requested of such a vacuum valve, the release of adsorbed gas or the transmission of atmospheric gas cannot be bypassed.

According to JP-A-51-130873, a vacuum exhaust element is attached so as to project from a vacuum vessel to the outside. However, the vacuum exhaust element is provided in portion connected to the bus. Therefore, there is a problem that an insulating transformer is required for a power source so that the whole size of the vacuum switch with the insulating transformer becomes larger.

SUMMARY OF THE INVENTION

It is an object of the present invention to provide a vacuum exhaust element of a vacuum switch which is miniaturized and which is safe for maintenance and inspection.

In order to attain the foregoing object, according to an aspect of the present invention, in a vacuum switch in which a pair of electrodes are disposed in opposition to each other in a grounded vacuum vessel so that one of the electrodes is detachably brought into contact with the other electrode, and rods connected with the electrodes extend to the outside from the grounded vacuum vessel, there is provided a vacuum exhaust element comprising: a projection portion projecting to the outside from a part of the grounded vacuum vessel; a magnetic field generator disposed outside the projection portion; and a power source circuit connected with an electrode and a getter which are provided in the projection portion.

According to another aspect of the present invention, a vacuum exhaust element has a projection portion projecting from a part of the grounded vacuum vessel in the same direction as one of rods connected to the electrodes respectively; a magnetic field generator disposed outside the projection portion; and a power source circuit connected with an electrode and a getter which are provided in the projection portion.

According to another aspect of the present invention, a vacuum exhaust element has a projection portion projecting from a part of the grounded vacuum vessel in the same direction as one of rods connected to the electrodes respectively; a magnetic field generator disposed outside the projection portion; and a power source circuit connected with an electrode and a getter which are provided in the projection portion. The vacuum exhaust element is made shorter than the one rod.

The vacuum exhaust element may be disposed under the one rod in opposition to each other.

In the vacuum exhaust element, the vacuum vessel and the power source circuit may be connected to the ground.

In the vacuum exhaust element, an insulator may be put between the grounded vacuum vessel and the projection portion.

In the vacuum exhaust element, the electrode provided in the projection portion may be constituted by a high-voltage-side electrode and a low-voltage-side electrode through an electric discharge gap.

In the vacuum exhaust element, a getter layer may be provided in an inner wall surface of the projection portion.

In the vacuum exhaust element, an insulation resistance meter may be connected to the power source circuit.

DETAILED DESCRIPTION OF THE EMBODIMENTS

Figure 1:
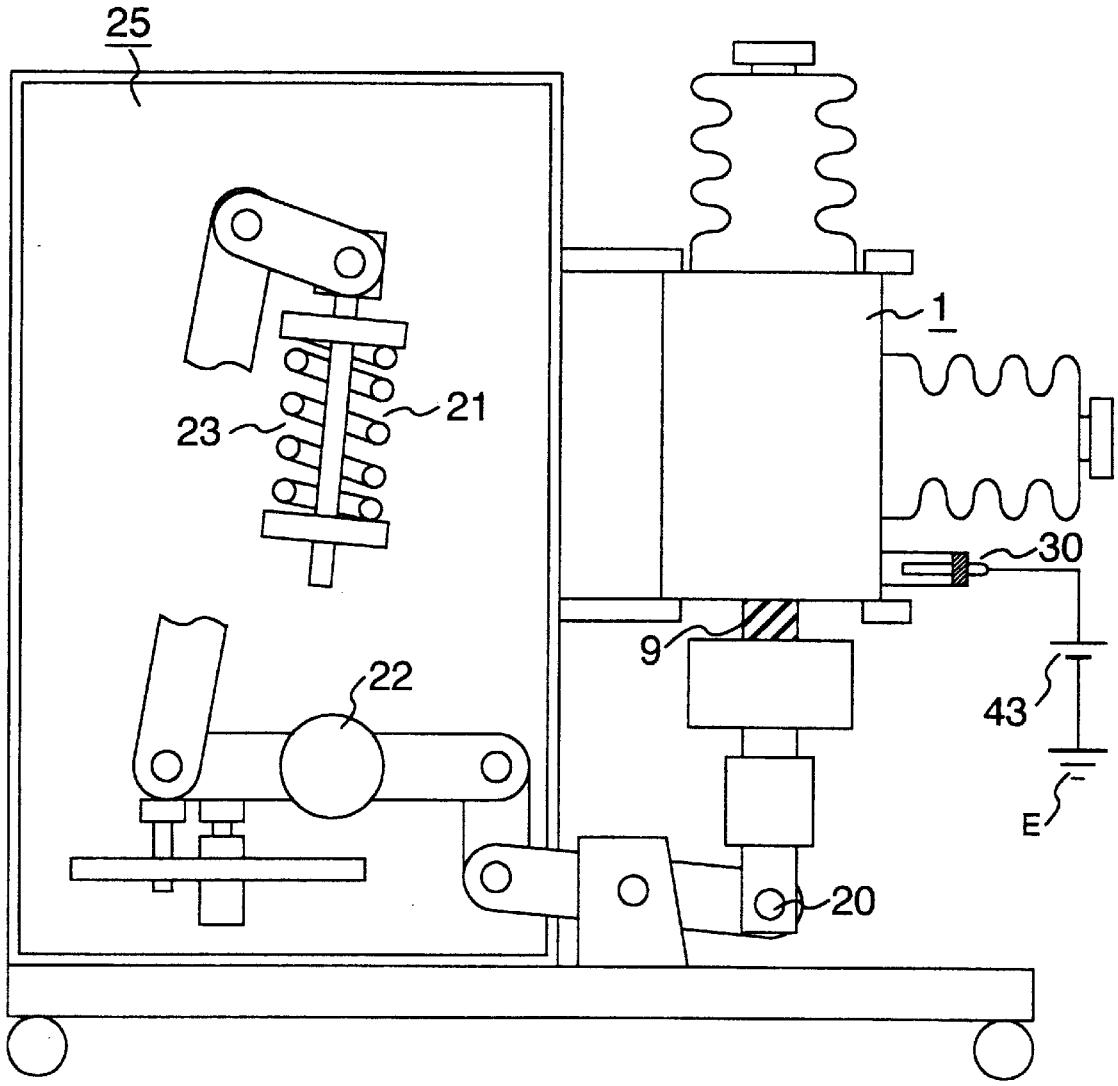
FIG. 1 is a schematic sectional view of a vacuum switch according to an embodiment of the present invention.

A first embodiment of the present invention will be described. FIG. 1 is an overall configuration view of a vacuum switch, and FIG. 2 is a detail sectional view of a vacuum valve 1.

A vacuum switch will be described with reference to FIG. 1. FIG. 1 shows a switchgear for operating the vacuum valve 1 by an operating mechanism 25. The operating mechanism 25 is chiefly constituted by an interrupting spring 21. Released by a trip mechanism provided with a stopper 23 individually, the interrupting spring 21 generates driving force which is transmitted to an insulating rod 9 through a shaft 22. As a result, the insulating rod 9 is driven up/down so that a fixed electrode 5 and a movable electrode 6 are closed/opened.

Figure 2:
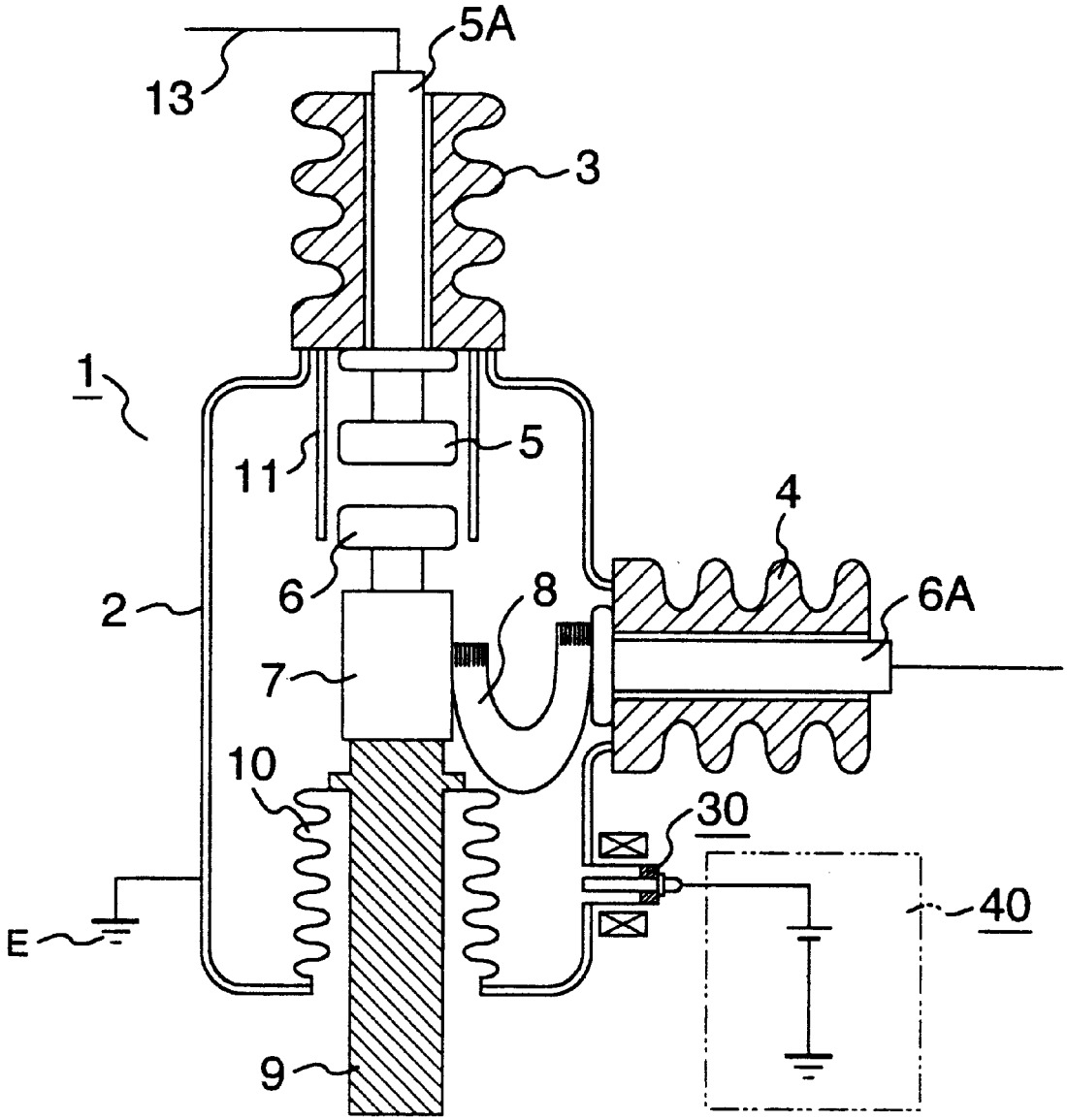
FIG. 2 is an enlarged typical view of a vacuum valve used in FIG. 1.

A pair of bushings 3 and 4 are provided around a vacuum vessel 2 which is connected to the ground E to thereby form the vacuum valve 1, as shown in FIG. 2. The two bushings 3 and 4 are disposed perpendicularly to each other on the vacuum vessel 2. The movable electrode 6 is made to abut against or depart from the fixed electrode 5 disposed inside the vacuum vessel 2 so as to perform switching on or off. A rod 5A is fixed to the bushing 3 and connected to the fixed electrode 5. A rod 6A is fixed to the bushing 4 and connected to the movable electrode 6 through a flexible conductor 8. That is, for the fixed and movable electrodes 5 and 6, the rods 5A and 6A extend from the inside of the vacuum vessel 2 to the outside perpendicularly to each other so as to penetrate the bushings 3 and 4, respectively.

In the vacuum valve 1 according to this embodiment, an electric current flows in the patch from the rod 5A to the rod 6A through the fixed electrode 5, the movable electrode 6 and the flexible conductor 8. The movable electrode 6 and the insulating rod 9 are fixed to the vacuum vessel 2 through bellows 10. The forward end of the insulating rod 9 is mechanically coupled with the operating mechanism 25. An arc shield 11 interrupts electric short-circuit between the vacuum vessel 2 and the rod 5A due to arc produced at the time of switching-off to thereby prevent a ground fault.

Figure 3:
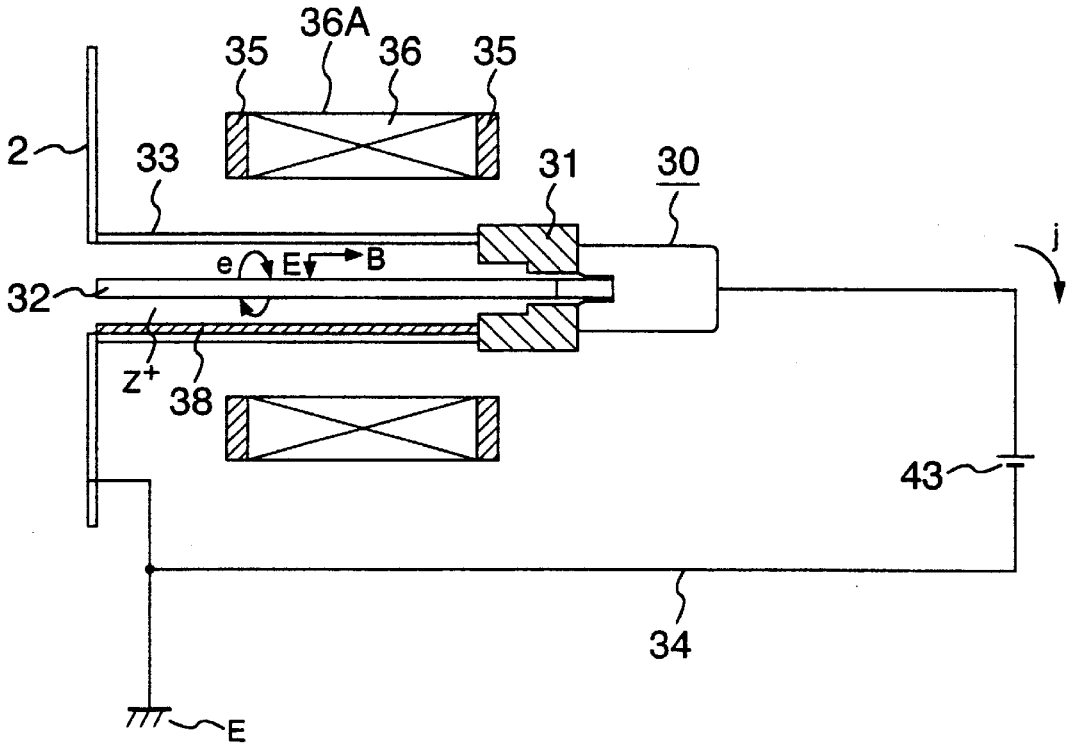
FIG. 3 is a side sectional view of a vacuum exhaust element attached to the vacuum valve used in FIGS. 1 and 2.
Figure 4:
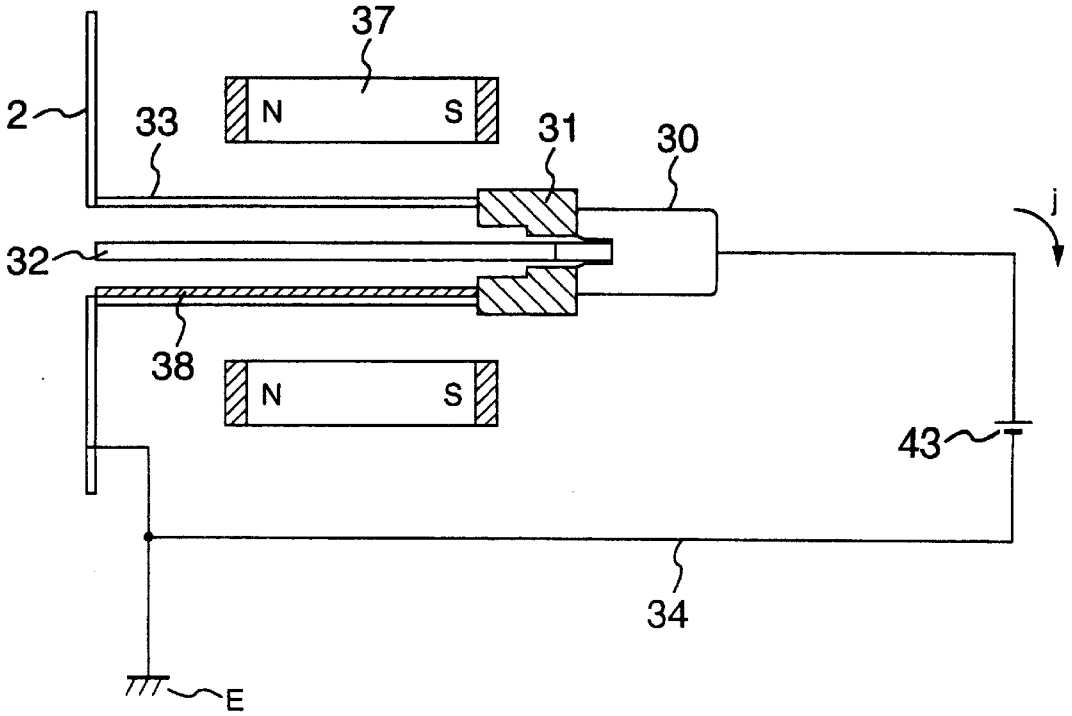
FIG. 4 is a side sectional view of another vacuum exhaust element attached to the vacuum valve according to another embodiment of the present invention.

A vacuum exhaust element 30 is attached to the side surface of the vacuum vessel 2 in the same direction as the bushing 4. The detailed structure of the vacuum exhaust element 30 is shown in FIG. 3, and is explained with reference to FIG. 3. The vacuum exhaust element 30 is constituted by a projection portion 33, an electrode 32, a power source circuit 34, a getter 38, and a magnetic field generator 36A. The projection portion 33 is made of a metal vessel and formed on a part of the side surface of the vacuum vessel 2 so as to project in the same direction as the bushing 4. The electrode 32 is provided in the projection portion 33 so as to communicate with the outside and inside of the vacuum vessel 2. The power source circuit 34 is connected to the electrode 32. The getter 38 is provided in the projection portion 33 correspondingly to the electrode 32 so as to have the same potential as the projection portion 33. The magnetic field generator 36A has an iron plate 35 disposed around the projection portion 33, and a coil 36 wound around the iron core. The iron plates 35 prevent the magnetic flux produced by coil current from entering the vacuum vessel. An insulating portion 31 is provided between the electrode 32 and the projection portion 33 so as to electrically insulate them from each other. Such an insulating portion may be provided at a part of the electrode 32. A DC power source 43 is connected to the power source circuit 34. The DC power source 43 used in FIG. 3 may be replaced by an AC positive pulse generating circuit. The coil 36 may be replaced by a ring-like permanent magnet 37 as shown in FIG. 4. Then, the polarities N and S of the permanent 5 magnet may be replaced by each other. The power source circuit 34 is connected to the ground E.

Next, description will be made about the operation of the vacuum exhaust element 30.

A DC voltage is applied to the power source circuit 34. Electrons e discharged from the inner wall of the projection portion 33 is affected by Lorentz force due to an electric field E and a magnetic field B applied by the coil 36. Thus, the electrons e circulate around the electrode 32. The circulating electrons e ionize residual gas in the vessel by collision therewith. Thus, the residual gas is made into positive ions Z, which are captured by the getter 38 at the same potential as the projection portion 33.

Figure 5:
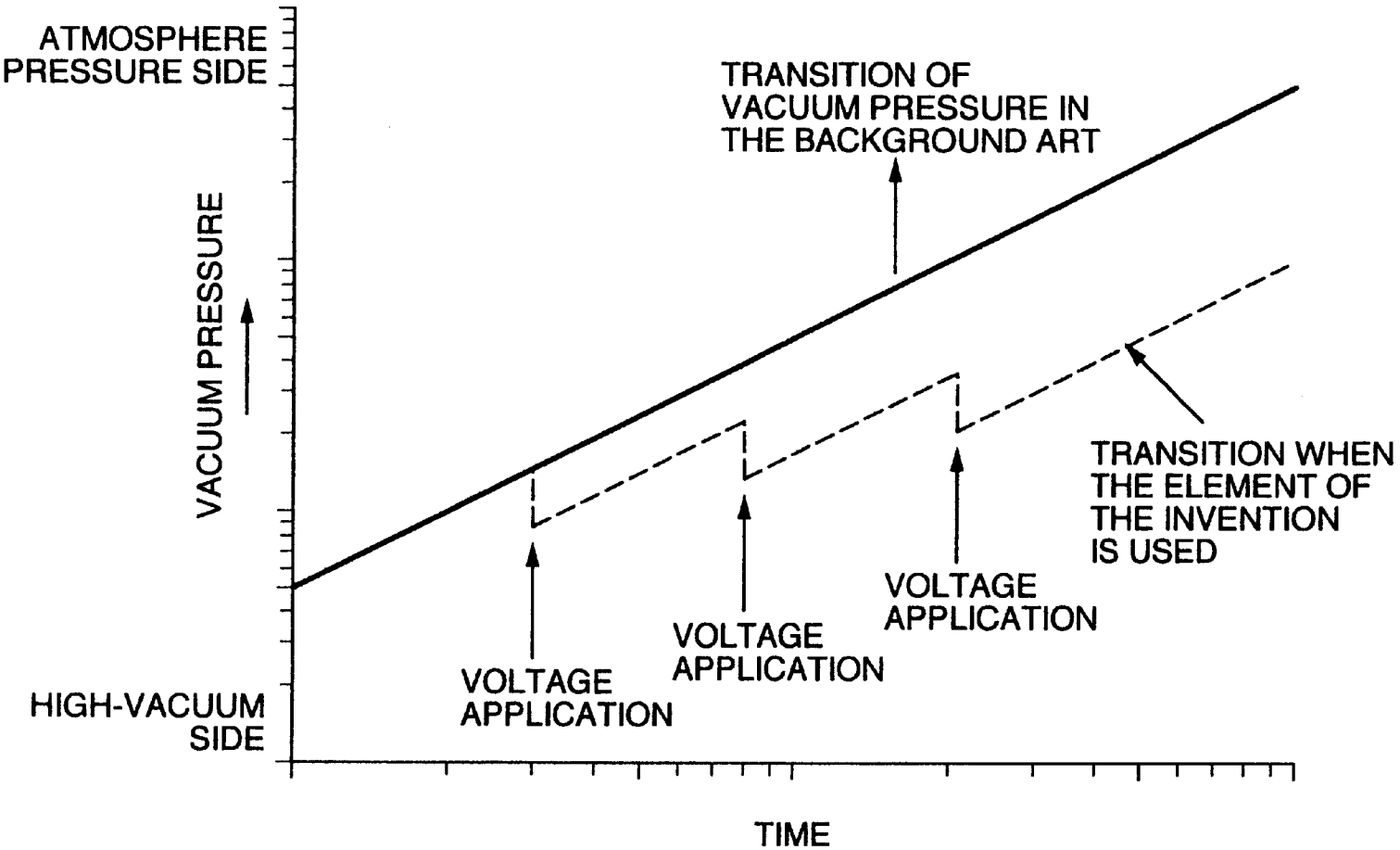
FIG. 5 is a vacuum pressure transition characteristic graph when a vacuum exhaust element according to the present invention is attached.

In such a manner, according to the present invention, the positive ions Z are attracted at a high speed by the getter 38 at the same potential as the projection portion 38. Therefore, in comparison with the case where a getter is provided simply, it is possible to enhance the exhaust efficiency and it is difficult to accelerate deterioration in vacuum. Thus, the reliability against deterioration in vacuum increases. As a result, it is possible to provide a vacuum switch which is high in safety. Incidentally, the voltage application may be carried out all the time or only at the time of maintenance/inspection. In the latter case, the vacuum pressure changes as shown in FIG. 5. In FIG. 5, the time of "voltage application" means the time of "maintenance/inspection".

Description will be made below about the effect of the present invention. According to the present invention, the vacuum vessel 2 and the power source circuit 34 are connected to the ground E, so that their potentials are always zero. Accordingly, the vacuum exhaust element 30 does not need a withstand voltage in which a higher voltage than in a conventional vacuum exhaust element is taken into account. That is, it will go well if the vacuum exhaust element 30 has an ordinary withstand voltage. Accordingly, the vacuum exhaust element 30 according to the present invention can be miniaturized in comparison with the conventional vacuum exhaust element. In addition, it is safe for a worker to touch the vacuum vessel 2 and the vacuum exhaust element 30 when the worker carries out maintenance/inspection.

On the other hand, according to the present invention, the vacuum exhaust element 30 is configured as follows. That is, the rods 5A and 6A connected to the both electrodes extend to the outside from the vacuum vessel perpendicularly to each other. The projection portion 33 is provided on a part of the vacuum vessel so as to project in the same direction as the rod 6A. The magnetic field generator 36 is disposed around the projection portion 33. The electrode 32 and the getter 38 are disposed in the projection portion 33. The electrode 32 communicates with the inside and outside of the vacuum vessel. The electrode 32 is connected to one terminal of the power source circuit 34 while the other terminal of the power source circuit 34 is connected to the getter 38 having the same potential as the projection portion 33.

In this embodiment, the vacuum exhaust element 30 is disposed under the bushing 4. Accordingly, dust, dirt, and so on, may lie on the bushing 4, but they seldom lie on the vacuum exhaust element 30. It is therefore unnecessary to clean the vacuum exhaust element 30 frequently.

Further, the vacuum exhaust element 30 is made shorter than the bushing 4. Accordingly, at the time of manufacture or installation, the longer bushing 4 is the first to collide with a transporter so that the vacuum exhaust element 30 is protected. Thus, the vacuum exhaust element 30 is hard to be broken. To say this in different words, the vacuum exhaust element 30 is connected to the ground E so that the element 30 can be made small enough to be disposed under the bushing 4. Moreover, because the vacuum vessel 2 and the vacuum exhaust element 30 are connected to the ground E, it is safe for a worker to touch the vacuum vessel 2 and the vacuum exhaust element 30 when the worker carries out maintenance/inspection upon the vacuum exhaust element 30.

(Second Embodiment)

Figure 6:
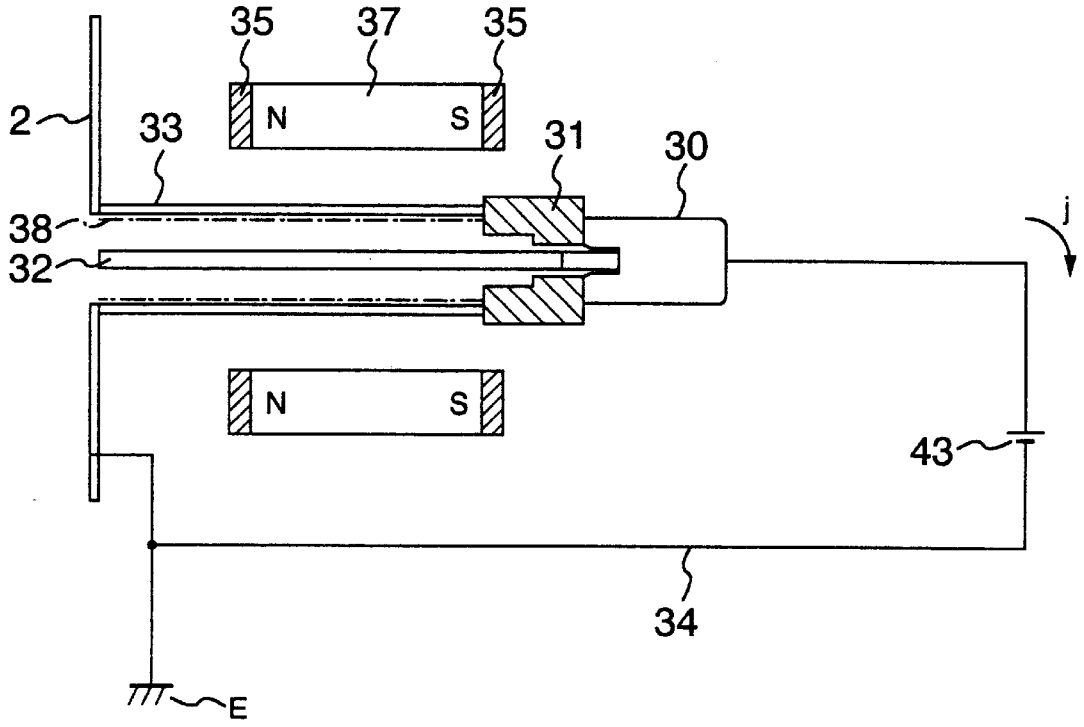
FIG. 6 is a side sectional view of another vacuum exhaust element attached to the vacuum valve according to another embodiment of the present invention.

Description will be made about a second embodiment of the present invention with reference to FIG. 6. The principle of the operation in this embodiment is similar to that explained about FIG. 3. In this embodiment, a getter layer 38 is formed by coating the inner wall of the projection portion with getter material such as titanium, zirconium, or the like. Thus, there is obtained an effect similar to that in the first embodiment. Further, the extent of the getter layer 38 is enlarged to increase the area to capture the positive ions Z. Alternatively, the projection portion 33 is composed of getter material. Or even if a thin film of getter material is pasted onto the inner wall of the projection portion 33, there is obtained a similar effect.

(Third Embodiment)

Figure 7:
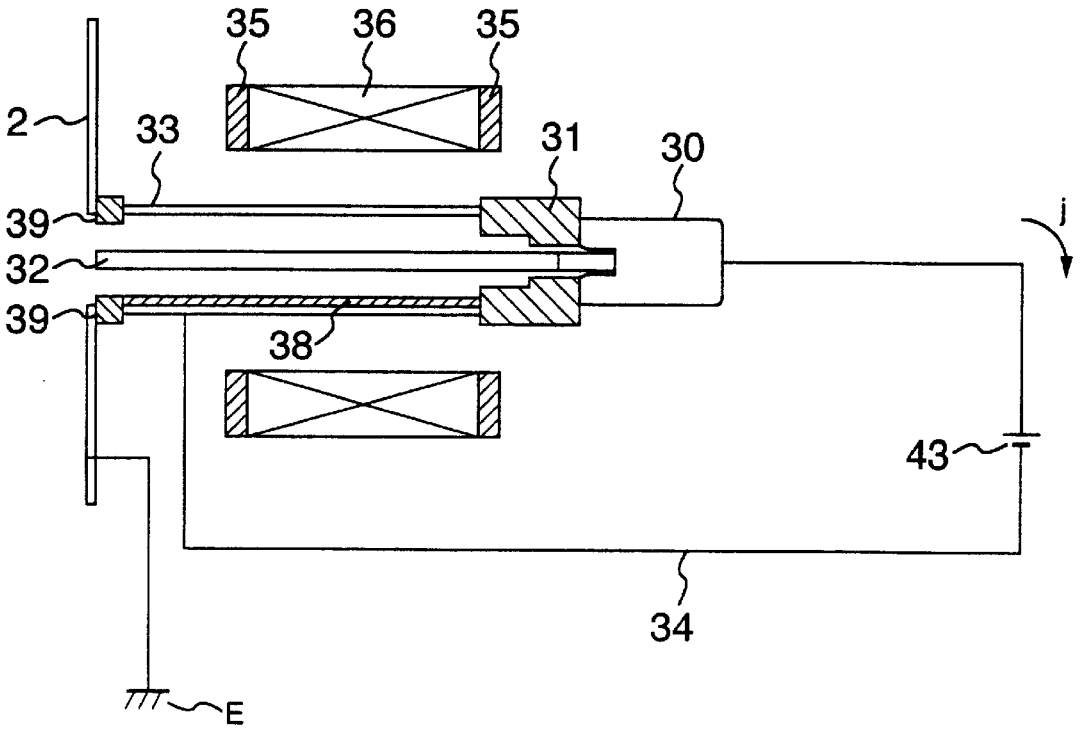
FIG. 7 is a side sectional view of another vacuum exhaust element attached to the vacuum valve according to another embodiment of the present invention.

Description will be made about a third embodiment of the present invention with reference to FIG. 7. In this embodiment, an insulator 39 is provided in a part of the space between the vacuum vessel 2 and the projection portion 33 so as to electrically insulate the vacuum exhaust element 30 described in FIG. 3 and the vacuum vessel 2 from each other. Thus, in this embodiment, even if there happened an accident such as a ground fault, or the like, a large current would not flow into an external power source circuit. As a result, it is possible to protect equipment such as the vacuum exhaust element 30, the DC power source 43, and so on, and to ensure safety for a worker when the worker carries out maintenance/inspection. It is therefore possible to enhance the reliability of the switchgear.

(Fourth Embodiment)

Figure 8:
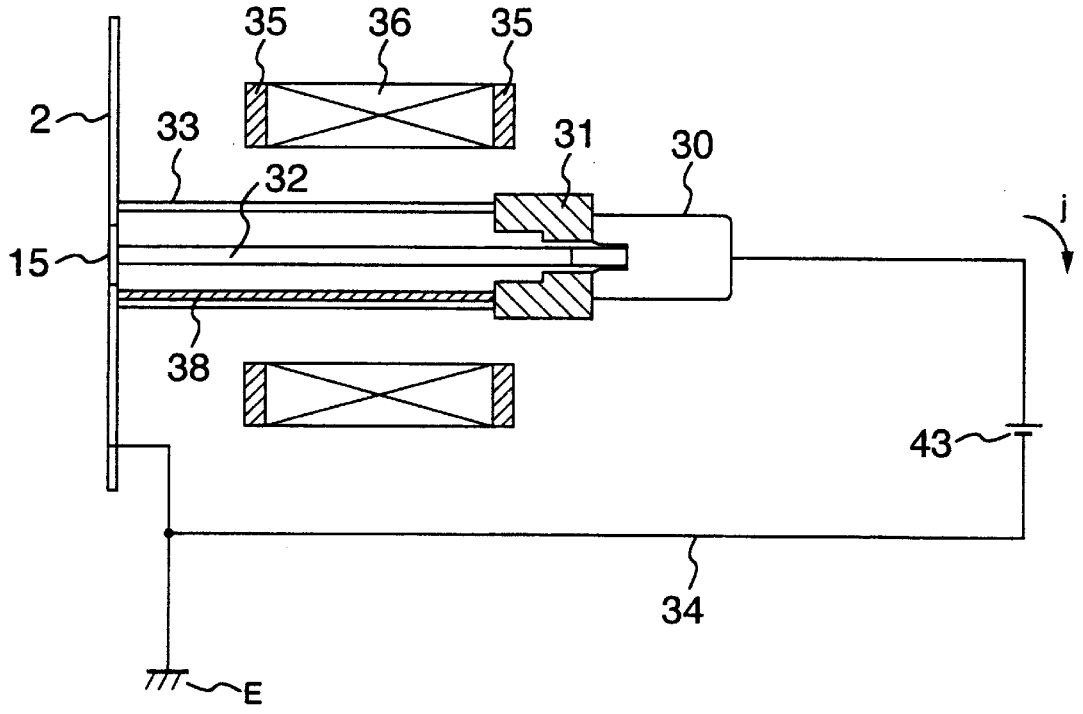
FIG. 8 is a side sectional view of another vacuum exhaust element attached to the vacuum valve according to another embodiment of the present invention.

Description will be made about a fourth embodiment of the present invention with reference to FIG. 8. The principle of the operation in this embodiment is similar to that explained about FIG. 3. Here, an opening portion 15 of the metal vessel is made smaller than the projection portion 33 of the vacuum exhaust element 30, or a conductor at the same potential as the projection portion 33 is provided in the opening portion. Accordingly, electrons trying to enter the vacuum vessel are repulsed so that the ionizing efficiency is improved while deterioration in insulation can be avoided in the vacuum vessel. In addition, a grid at the same potential as the projection portion is provided in the opening portion 15 so that electrons are prevented from entering the vacuum vessel. Thus, the influence of sputtering can be further prevented at the beginning of the operation.

(Fifth Embodiment)

Figure 9:
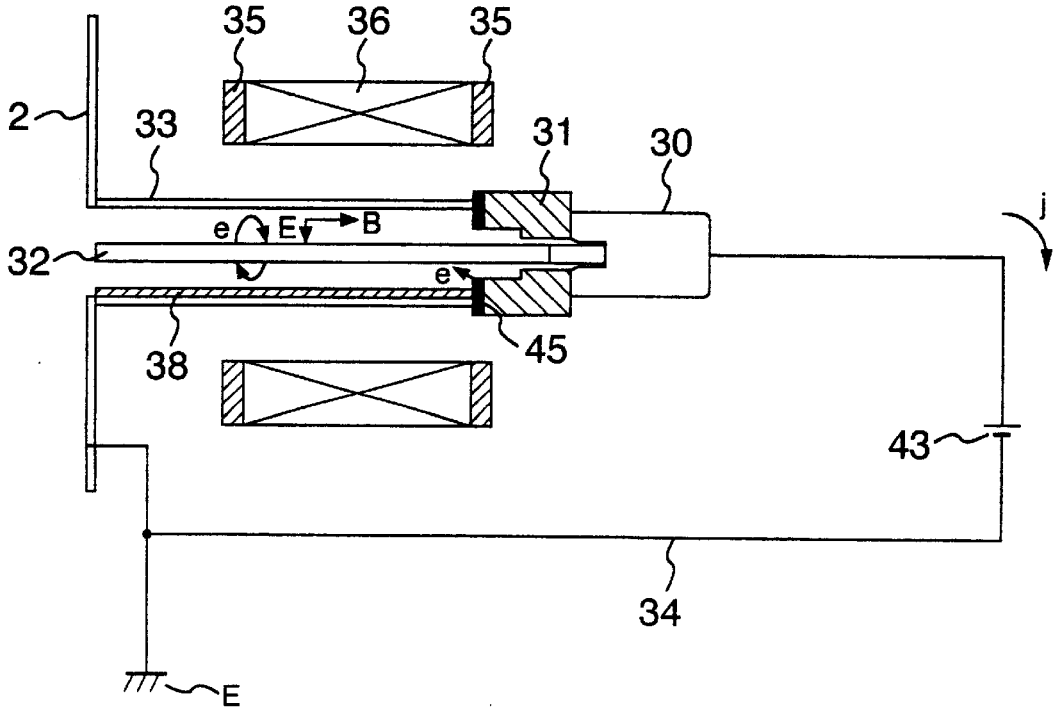
FIG. 9 is a side sectional view of another vacuum exhaust element attached to the vacuum valve according to another embodiment of the present invention.

Description will be made about a fifth embodiment of the present invention with reference to FIG. 9. The principle of the operation in this embodiment is similar to that explained about FIG. 3. A metallized surface 45 is provided between the projection portion 33 and the insulating portion 31 and between the getter 38 and the insulating portion 31. The metallized surface 45 is used as an electron discharge source aggressively. This embodiment has an advantage that the intensity of the electric field is increased locally.

(Sixth Embodiment)

Figure 10:
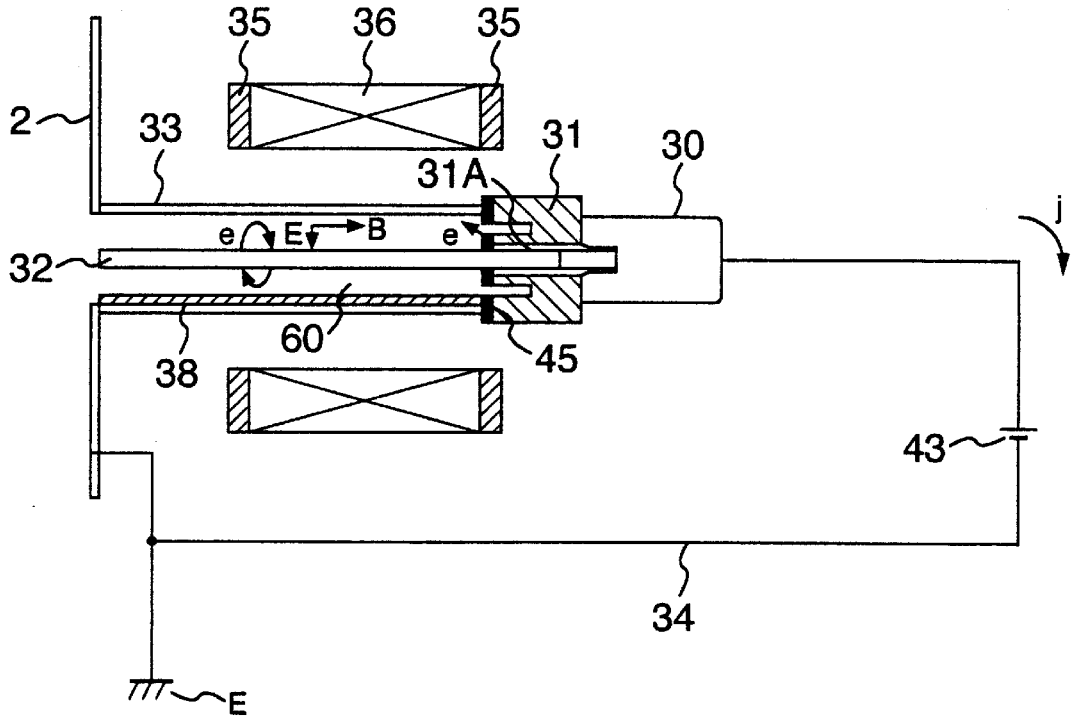
FIG. 10 is a side sectional view of another vacuum exhaust element attached to the vacuum valve according to another embodiment of the present invention.

Description will be made about a sixth embodiment of the present invention with reference to FIG. 10. In this embodiment, a high voltage is applied between the high-voltage-side electrode 32 and the low-voltage-side electrode (getter) 38 which are insulated from each other by the insulating portion 31 and disposed through a discharge gap 60. When discharge starts, ionized gas is generated. Thus, the adsorbing efficiency of the getter 38 disposed near the electrode is enhanced.

(Seventh Embodiment)

Figure 11:
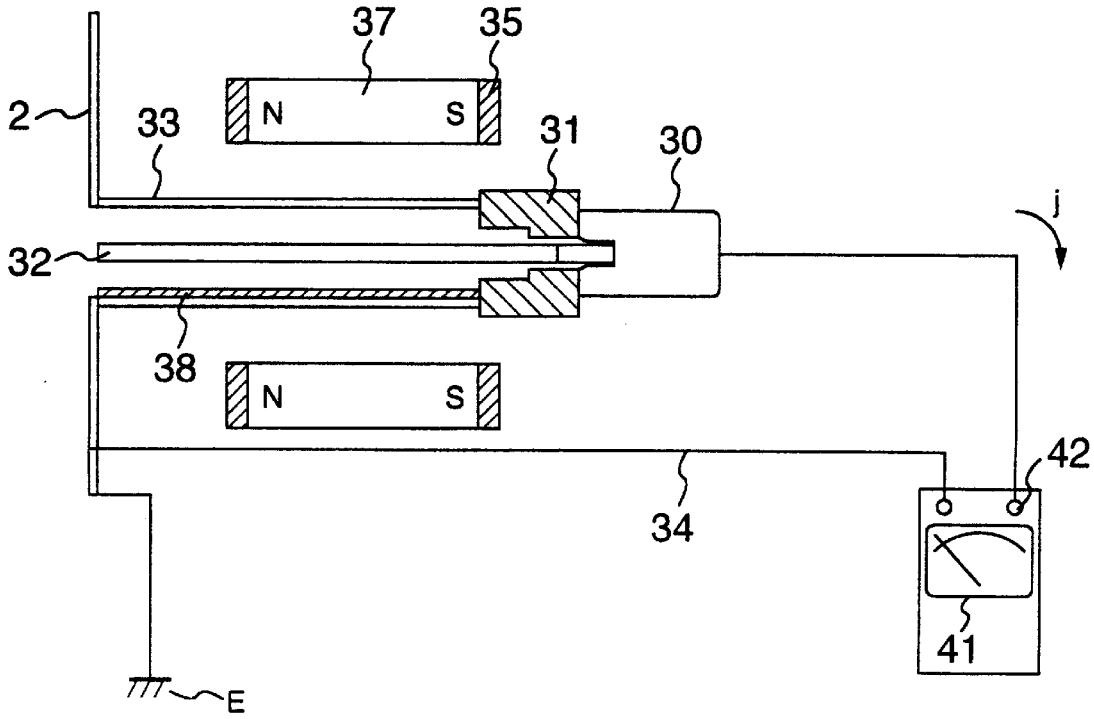
FIG. 11 is a side sectional view of another vacuum exhaust element attached to the vacuum valve according to another embodiment of the present invention.

Description will be made about a seventh embodiment of the present invention with reference to FIG. 11. The principle of the operation in this embodiment is similar to that explained about FIG. 3. In this embodiment, a megger 41, which is an insulation resistance meter, is used as the DC power source 43 for the power source circuit 34. The megger 41 generates a DC voltage which is applied to the vacuum exhaust element 30. The megger 41 is a handy-type measuring instrument for applying a DC voltage of several kV to an insulator and detecting a leakage current to thereby measure a resistance value of MΩ level. Such a megger is one of measuring instruments which maintainers/managers for high-voltage apparatus usually have.

As has been described, according to the present invention, a projection portion including an electron generating source is connected to a vacuum vessel grounded, and a getter at the same potential as the projection portion is disposed inside the projection portion. Accordingly, in comparison with a conventional switchgear in which getter material is disposed in a vacuum valve, positive ions are attracted at a high speed by the getter having the same potential as the projection portion. Thus, the exhaust effect is improved. As a result, the reliability against deterioration in vacuum is increased so that it is possible to provide a vacuum switch which is long in life and high in safety.

In addition, because the vacuum vessel and a power source circuit are grounded in the present invention, they are always at zero potential, so that the vacuum exhaust element does not need a withstand voltage in which a high voltage is taken into account. That is, it will go well if the vacuum exhaust element has an ordinary withstand voltage. Accordingly, the vacuum exhaust element can be miniaturized. In addition, it is safe for a worker to touch the vacuum exhaust element when maintenance/inspection is carried out.

As Further, the vacuum exhaust element is disposed under one of rods coated with an insulating coating. Accordingly, dust, dirt, and so on, may lie on a bushing but they seldom lie on the vacuum exhaust element. It is therefore unnecessary to clean the vacuum exhaust element frequently. In addition, the vacuum exhaust element is made shorter than the one of the rods. Accordingly, at the time of manufacture or installation, the longer bushing is the first to collide with a transporter, so as to protect the vacuum exhaust element. Thus, the vacuum exhaust element is hard to be broken.

What is claimed is:

1. A vacuum exhaust element of a vacuum switch in which a pair of electrodes are disposed in a grounded vacuum vessel so that one of said electrodes is detachably brought into contact with the other electrode, and rods connected with said electrodes extend to the outside from said vacuum vessel, said vacuum exhaust element comprising:

a projection portion projecting to the outside from a part of said vacuum vessel, said projection portion having a chamber formed to communicate with said vacuum vessel;

a magnetic field generator disposed outside said projection portion; and a power source circuit having on e terminal connected with an electrode and another terminal connected to a getter, with both said electrode and said getter being provided in said projection portion and said getter having the same potential as said projection portion.

2. A vacuum exhaust element of a vacuum switch according to any one of claim 1, wherein an insulator is put between said vacuum vessel and said projection portion.

3. A vacuum exhaust element of a vacuum switch according to any one of claim 1, wherein said electrode provided in said projection portion is constituted by a high-voltage-side electrode and a low-voltage-side electrode through an electric discharge gap.

4. A vacuum exhaust element of a vacuum switch according to any one of claim 1, wherein a getter layer is provided on an inner wall surface of said projection portion.

5. A vacuum exhaust element of a vacuum switch according to any one of claim 1, wherein an insulation resistance meter is connected to said power source circuit.

6. A vacuum exhaust element of a vacuum switch in which a pair of electrodes are disposed in opposition to each other in a grounded vacuum vessel so that one of said electrodes is mounted on an insulator mechanically coupled with an operating mechanism to be detachably brought into contact with the other electrode, and rods connected with said electrodes extend to the outside from said vacuum vessel in directions perpendicular to each other, said vacuum exhaust element comprising:

a projection portion projecting from a part of said vacuum vessel in the same direction as one of said rods;

a magnetic field generator disposed outside said projection portion; and a power source circuit connected with an electrode and a getter which are provided in said projection portion.

7. A vacuum exhaust element of a vacuum switch according to claim 6, wherein said power source circuit is connected to ground.

8. A vacuum exhaust element of a vacuum switch according to any one of claim 6, wherein an insulator is put between said vacuum vessel and said projection portion.

9. A vacuum exhaust element of a vacuum switch according to any one of claim 6, wherein said electrode provided in said projection portion is constituted by a high-voltage-side electrode and a low-voltage-side electrode through an electric discharge gap.

10. A vacuum exhaust element of a vacuum switch according to any one of claim 6, wherein a getter layer is provided on an inner wall surface of said projection portion.

11. A vacuum exhaust element of a vacuum switch according to any one of claim 6, wherein an insulation resistance meter is connected to said power source circuit.

12. A vacuum exhaust element of a vacuum switch in which a pair of electrodes are disposed in opposition to each other in a grounded vacuum vessel so that one of said electrodes is mounted on an insulator mechanically coupled with an operating mechanism to be detachably brought into contact with the other electrode, and rods connected with said electrodes extend to the outside from said vacuum vessel in directions perpendicular to each other, said vacuum exhaust element comprising:

a projection portion projecting from a part of said vacuum vessel in the same direction as one of said rods;

a magnetic field generator disposed outside said projection portion; and a power source circuit connected with an electrode and a getter which are provided in said projection portion, wherein said vacuum exhaust element is shorter than said one of said rods.

13. A vacuum exhaust element of a vacuum switch according to any one of claim 12, wherein each of said vacuum vessel and said power source circuit is connected to the ground.

14. A vacuum exhaust element of a vacuum switch according to any one of claim 12, wherein an insulator is put between said vacuum vessel and said projection portion.

15. A vacuum exhaust element of a vacuum switch according to any one of claim 12, wherein said electrode provided in said projection portion is constituted by a high-voltage-side electrode and a low-voltage-side electrode through an electric discharge gap.

16. A vacuum exhaust element of a vacuum switch according to any one of claim 12, wherein a getter layer is provided on an inner wall surface of said projection portion.

17. A vacuum exhaust element of a vacuum switch according to any one of claim 12, wherein an insulation resistance meter is connected to said power source circuit.

18. A vacuum exhaust element of a vacuum switch in which a pair of electrodes are disposed in opposition to each other in a grounded vacuum vessel so that one of said electrodes is mounted on an insulator mechanically coupled with an operating mechanism to be detachably brought into contact with the other electrode, and rods connected with said electrodes extend to the outside from said vacuum vessel in directions perpendicular to each other, said vacuum exhaust element comprising:

a projection portion projecting from a part of said vacuum vessel in the same direction as one of said rods;

a magnetic field generator disposed outside said projection portion; and a power source circuit connected with an electrode and a getter which are provided in said projection portion, wherein said vacuum exhaust element is disposed under said one rod in opposition to each other.

19. A vacuum exhaust element of a vacuum switch according to claim 18, wherein said power source circuit is connected to ground.

20. A vacuum exhaust element of a vacuum switch according to any one of claim 18, wherein a getter layer is provided on an inner wall surface of said projection portion.

21. A vacuum exhaust element of a vacuum switch according to any one of claim 18, wherein an insulation resistance meter is connected to said power source circuit.

* * * * *